US006280272B1

(12) United States Patent
Masse

(10) Patent No.: US 6,280,272 B1
(45) Date of Patent: Aug. 28, 2001

(54) SHORT MOTION SWIM FIN

(76) Inventor: E Roger Masse, 340 Washington St., Tappan, NY (US) 10983

( * ) Notice: Subject to any disclaimer, the term of this patent is extended or adjusted under 35 U.S.C. 154(b) by 0 days.

(21) Appl. No.: 09/606,361

(22) Filed: Jun. 29, 2000

Related U.S. Application Data

(63) Continuation-in-part of application No. 09/354,437, filed on Jul. 16, 1999, now Pat. No. 6,123,594.

(51) Int. Cl.[7] ..... A63B 31/08
(52) U.S. Cl. ..... 441/64
(58) Field of Search ..... 441/61–64; D21/806

(56) References Cited

U.S. PATENT DOCUMENTS 2,099,973 * 11/1937 Corlieu ..... 441/64
2,588,363 * 3/1952 Corlieu ..... 441/64

* cited by examiner

*Primary Examiner*—Ed Swinehart
(74) *Attorney, Agent, or Firm*—Richard A. Joel, Esq

(57) ABSTRACT

A short motion swim fin used as training device for the improvement of the fast flutter kick motions of speed swimming and as such uses a flat flexible plate which is rigid across its base, and inner rubber sheath surrounding the plate and an outer sheath which varies in length depending upon the rigidity desired by thereby varying a projecting portion of the plate which contact the water. The plate functions as a lever on the underside of the foot to stretch the arch of the foot on every downward kick, as well as to strengthen the fast twitch leg muscles associated with a strong flutter kick.

11 Claims, 3 Drawing Sheets

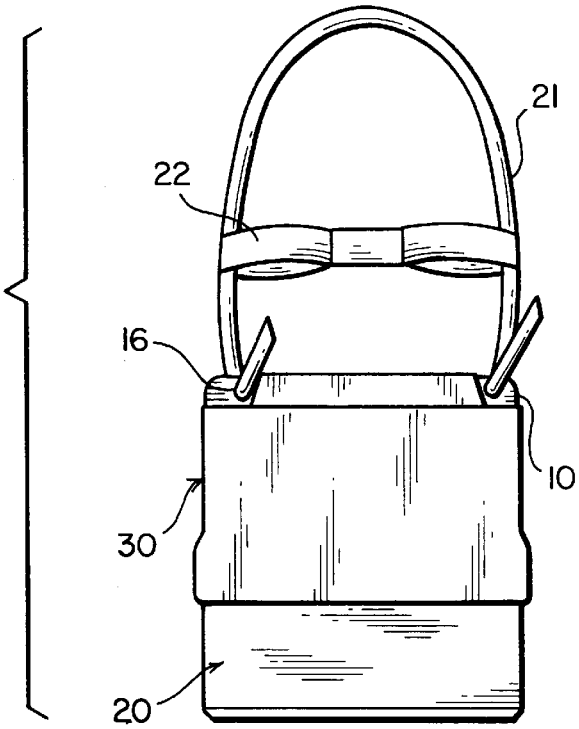
FIG. 6
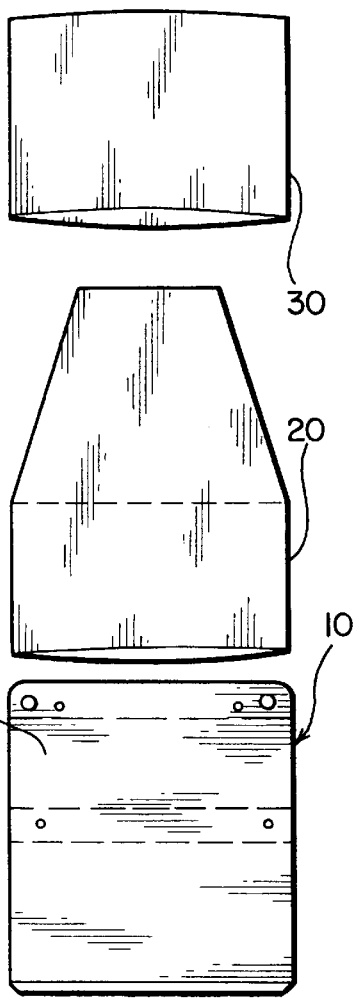
FIG. 3
FIG. 4a
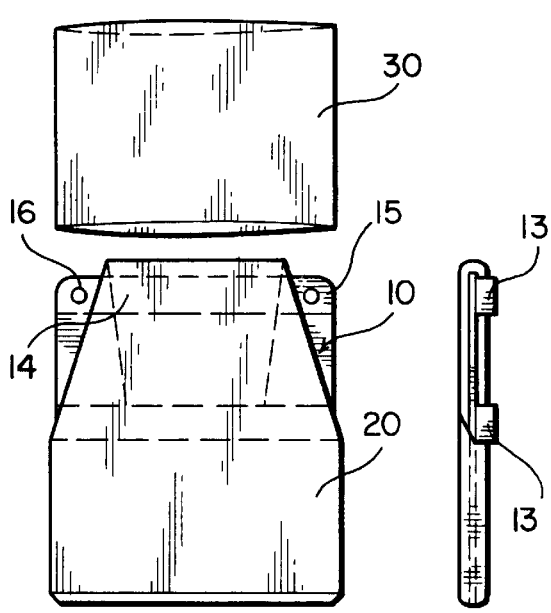
FIG. 4b

SHORT MOTION SWIM FIN

CROSS-REFERENCE TO RELATED APPLICATIONS

This application is a continuation in part of Ser. No. 09/354,437, filed Jul. 16, 1999, now U.S. Pat. No. 6,123,594.

STATEMENT REGARDING FEDERALLY SPONSORED RESEARCH OR DEVELOPMENT

Research and development of the present invention and application have not been federally sponsored, and no rights are given under any Federal program.

REFERENCE TO A MICROFICHE APPENDIX

Not applicable

BACKGROUND OF THE INVENTION

Field of the Invention

This invention comprises a short motion swim fin that functions as a stretching device to stretch and increase the arch of the foot, and as a training device to strengthen the leg muscles that are used with the motions of flutter kick. This invention differs in design, function, and mechanics from all prior art relating to swim fins, wherein it is a training device for the competitive swimmer; and not designed or intended as a more efficient propulsion device. This invention is a training swim fin that when used over time will improve a swimmer's performance for competitive swimming without fins.

DESCRIPTION OF THE RELATED ART INCLUDING INFORMATION DISCLOSED UNER 37 CFR §§1.97–1.98

This invention is intended and designed specifically for use with the flutter kick, which is a short, fast motion kick, used for the front or back crawl whereby the body is parallel to the surface of the water with the legs moving up and down from the hips, in short, fast motions, knees slightly bending, and the feet kept loose. The extent of flexible arching of the feet is the critical element for converting the leg motion into propulsion by presenting an angle of attack from the loosely arching foot and every downward kick. The downward kick is the power portion of the flutter kick, whereas the upward motion is more for balance and recovery. The loosely arching function, if you will, as a propeller blade. In fact, many swimmers have a flutter kick that defines a spiral wake as a result of a well-defined arch. Although applicant's invention produces an impressive increase in propulsion, it does so as a result of short, fast, kicking motions, and accordingly is not designed or intended to conserve energy.

Whereas the relevant art studied discloses swim fins that are, for the most part, designed to function for underwater diving. And as such function for the propulsion efficiency in order to conserve energy, and they do so by using a common principle whereby the fin, in one form or another, is worn as a flexible extension of the foot so that the fin itself presents a greater surface, and angle of attack, against the water. This principle is well suited where conservation of energy, or air supply, is the primary consideration, but these fins are larger and also require at slower, longer kicking motion, comparable to using a larger gear to transfer power to a smaller gear for speed. These larger fins are not practical for the short, fast kicking motions of the flutter kick, or more specifically, as a training device for competitive swimming without fins.

In addition to the originality in use of this invention, there is also uniqueness in the design and mechanics. Specifically, it is a short fin that has a rectangular flat plate of thin flexible material, that when worn on the forward portion of the foot, acts as a lever to the foot with the fulcrum of that lever being on the underside of the foot. The effect of this lever action stretches the arch of the foot on every downward kick. The rigidity of the fin is also adjustable to the particular swimmer.

None of the prior art seen can be practically used, or is disclosed to be used, in a similar way as applicant's invention, specifically, as a stretching and training fin for the competitive swimmer and in particular, for the short motions of the flutter lick used in competitive swimming. None of the prior art seen employ the same mechanics, or make any similar claims of the mechanics for a swim fin with an adjustable flexible frame to lever the arch of the foot.

All prior art seen have as a common objective to be used in a dynamic fashion for moving a swimmer through the water more efficiently. The following U.S. Patents are considered relevant to the disclosure: U.S. Pat. Nos. 5,597,336; 5,552,748; 3,789,448; 2,556,894.

U.S. Pat. No. 5,597,336 to Evans, has an open instep, with planar heel, so as to accommodate a plurality of foot sizes and discloses simplification of a single, two part, molding process. It is designed as a propulsion enhancement device with an elongated, flexible blade that has stiffening ribs under the foot, along the longitudinal axis of the fin, and also features unique protuberances to further reduce drag upon the blade surface.

U.S. Pat. No. 5,552,748 to Cressi discloses a three-part swim fin that has all the parts joined along the bottom of the shoe, which is a full shoe attached to a forked, arcuate part that holds the elongated fin. This arrangement is primarily intended to reduce the costs of production as compared to that of molded rubber fins. A flipper for enhancing propulsion is provided, wherein the fin has an elongated, flexible, obtuse angle to the shoe, or bottom of the foot.

U.S. Pat. No. 3,789,448 to Mitchell discloses a swimming aid for hand and foot propulsion that works on foot propulsion by using the legs in a pedaling, or climbing motion, whereby its design cause a stronger push against the water on the backward motion that it does on the forward motion.

U.S. Pat. No. 2,556,894 to Axiotes, discloses a swimming device for hand and foot propulsion that works on foot propulsion by using the legs in a pedaling, or climbing motion, whereby the device is kept in a perpendicular attitude to the leg on the backward motion to push against the water, and straightened, or feathered, on the forward motion for less resistance.

The remaining U.S. Patents are mentioned as being of interest: U.S. Pat. Nos. 5,683,279; 3,302,223; 1,674,801; 3,922,740.

U.S. Pat. No. 5,583,729 to Raasch, et al, provides a multi-part diving fin designed for propulsion enhancement with a pivotal footplate that engages the blade, or fin portion, in a manner that allows for adjusting the tension of the elongated blade according to the swimmer's ability.

U.S. Pat. No. 3,302,233 to Ciccotelli, discloses a swim fin comprising a rigid, flat sole plate that hinges a U-shape element, holding a flexible web, as the fin portion. The swimming motion of the leg causes the frame to move up and down independently from the motion or position of the boot, in a manner that is tensioned cantilever, so arranged as to present a greater angle of attack to the water on the downward motion than on the upward motion. The swim fin is designed to enhance propulsion with minimal strain on the foot.

U.S. Pat. No. 1,674,801 to Schwalge, discloses a swimming appliance that is used with a pedaling or climbing motion whereby the pushing direction offers more resistance to the water than the pulling direction resulting in horizontal or vertical propulsion. This swimming appliance also features a reinforced sole that is suitable for limited walking out of the water.

U.S. Pat. No. 3,922,740 to Potter is a hand paddle and not applicable for wearing on the foot.

SUMMARY OF THE INVENTION

This invention relates to swim fins and particularly to short motion swim fins. In the preferred embodiment of the invention, the rigid U-shape frame of patent application Ser. No. 09/354,437 is replaced by a flat plate of thin, flexible material such as spring steel or a fiberglass composite The width end that fits under the arch of the foot is still referred to as the base end. The plate is kept flexible on the length; but made rigid on the width by fastening non-flexible ribs running along the width on the bottom side of the plate. These ribs, or stiffeners, are fabricated from aluminum or a rigid composite material. The ribs are fastened to the plate by rivets or by lamination in the configuration described so that the plate remains flexible along it's length, but made to be rigid along it's width.

The plate with attached stiffeners, is enclosed by the inner rubber sleeve in the same manner as the U-frame design whereby it forms a double surfaced closure on one end, but on the other end has only one diagonal flap that is folded over the base portion of the plate and secured so that it provides a rubber cushion to the bottom of the foot against the hard base edge of the plate.

The attachments to the swimmer's foot remain the same as for the U-shape frame disclosed in applicant's pending application Ser. No. 09/354,437.

Because the rigid U-shaped frame of applicant's Ser. No. 09/354,437 does not bend or flex it acts as an efficient stretching device when used with the flutter kick. Only the flexibility of the rubber sleeves dampens the forces placed upon the foot and leg muscles. Because of the limited flexibility of the rubber sleeves, the stress on the arch of the foot and leg muscles is considerable and can cause muscle cramping, particularly with swimmer's who have very muscular legs and/or a limited range of ankle motion.

On the other hand, the flexibility of the plate design places less stress on the foot, in fact, can be controlled by the thickness of the material. In effect, the flexible plate design allows for different stress levels according to the swimmer's choice and/or ability.

Accordingly, an object of this invention is to provide effective training swim fins for the competitive swimmer to use in swimming workouts to improve upon the propulsion efficiency of his or her flutter kick in competition, or when not using swim fins.

A more specific object of this invention is to provide rigid, short motion, swim fins that are worn on the forward portion of the feet, so as to arch the entire foot including all joints distal to the ankle.

Another specific object of this invention is to provide swim fins of a calculated small size, with flexible plate frame that is flexible on the length but rigid on the width to function as a lever to stretch the arch of the foot, so that the foot itself is included in the angle of attack. So in effect, the mechanics of the invention causes the foot to flex by the force of the water against the fin with every downward motion of the flutter kick.

A further object of this invention is to provide longitudinally flexible, short motion swim fins, that are small enough to allow a fast motion, but in a manner that requires the flexing motions of the entire foot, and as such also involves and strengthens those corresponding fast twitch leg muscles.

A still further object of this invention is to provide a pair of swim fins that are both the same and therefore interchangeable on either foot, and with one size to fit most foot sizes.

A still further object of this invention is to provide attachment components that make possible two different attachment methods to the foot of the swimmer for choice of comfort level.

BRIEF DESCRIPTION OF THE DRAWINGS

The above and other objects and advantages of this invention may be more clearly seen when viewed in conjunction with the accompanying drawings wherein:

FIG. 3 discloses all three major components used to make up the body of the swim fin, according to the description of the invention;

FIG. 4*a* shows the flat plate and inner rubber sleeve assembled with FIG. 4*b* showing a side view of the assembly;

FIG. 5*a* shows the outer, sleeve assembled over the inner sleeve while

FIG. 6 shows the mounting means attached on the plate of the swim fin assembly;

DETAILED DESCRIPTION OF THE INVENTION

Figure 1:
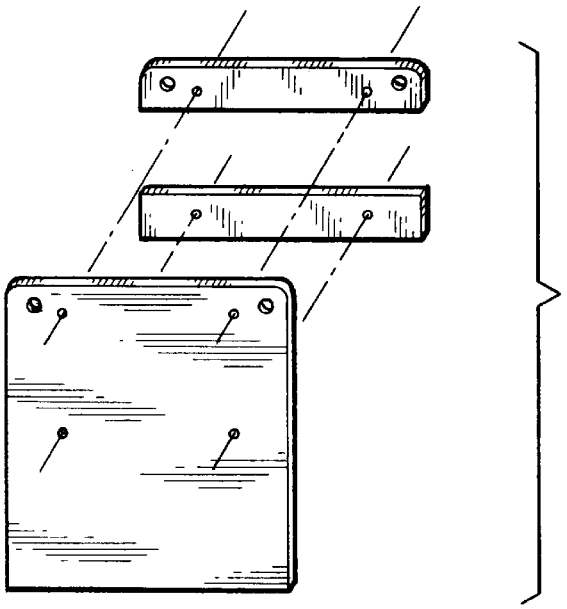
FIG. 1 is a top exploded perspective view of the three components that make up the flexible plate of the swim fin.
Figure 2A:
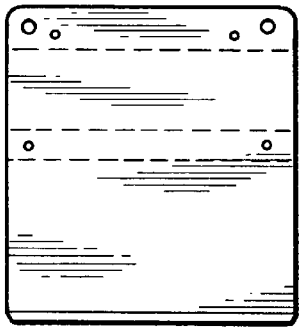
FIG. 2*a* is a front view of FIG. 1 showing two of the components assembled in phantom to the plate with addition of a side view in FIG. 2*b;*
Figure 2B:
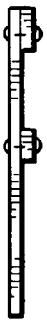

Referring now to the drawings, the rectangular flat plate 10 is shown in the exploded view of FIG. 1 with upper rib 11 and lower rib 12. The ribs 11 and 12 are assembled to the place 10 as shown in FIGS. 2*a* and 2*b*. The plate 10 comprises a thin flexible plate of material such as spring steel or a fiberglass composite having aperture 16 for rubber fasteners 21. The plate 10 is kept flexible on the length but made rigid on the width by fastening the non-flexible ribs 11, 12 running along the width on the bottom side of the plate 10. The ribs or stiffeners 11 and 12 are fabricated from aluminum or a rigid composite material. The ribs 11, 12 are fastened to the plate 10 by rivets 13 or lamination.

FIG. 3 discloses the three main components of the unique fin 50 sleeve 20 and the outer 30. The plate 10 with attached ribs 11 and 12 sleeve 20 in the same manner as the U-frame in applicant's previously cited pending application. The sleeve 20 forms a double surfaced closure at one end but on the other end has only and diagonal flap 14 that is folded over the base portion 15 of the plate 10, i.e., the portion 15 that fits under the arch of the foot, and secured so that it provides a rubber cushion to the bottom of the foot against the hard base edge of the plate 10.

Figure 5A:
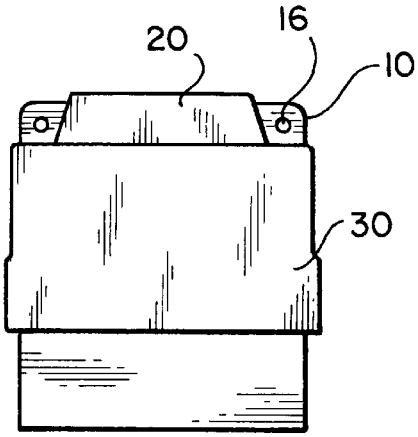
Figure 5B:
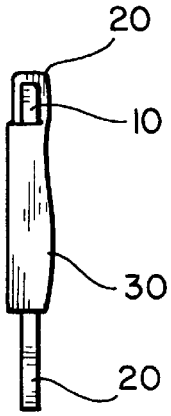
FIG. 5*b* shows a side view of the assembly.

The assembly of the plate 10 and inner sleeve 20 is shown in FIGS. 4*a* and 4*b*. FIGS. 5*a* and 5*b* show the assembly of the outer sleeve 30 over the inner sleeve 20 and plate 10. The attachments to the swimmer's foot are basically the same as in the U-frame design of applicant's pending application. The rubber tubular straps 21 are designed to fit over the heel and include a cross strap 22, which engages the upper portion of the foot. The tubular strap ends 23 and 24 and is inserted in holes 16 in the plate 10.

Because the rigid U-shaped frame of application Ser. No. 09/354,457 does not bend or flex it functions as an efficient stretching device when used with the flutter kick. Only the flexibility of the rubber sleeves 20 and 30 dampens the forces placed upon the foot and leg muscles. Because of the limited flexibility of the rubber sleeves 20 and 30, the stress on the arch of the foot and leg muscles is considerable and can cause muscle cramping, particularly with swimmers who have very muscular legs and/or a limited range of ankle motion.

The flexibility of the plate design disclosed herein places less stress on the foot and in fact can be controlled by the thickness of the material. In effect, the flexible plate design allows for different stress levels according to the swimmer's choice and/or ability.

Another advantage of the flexible plate design is that by reducing the pulling forces against the outer sleeve 30, it can be made narrower and still hold the foot firmly in place. By reducing the outer sleeve width more of the plate 10 is exposed for sculling action whereby the longer exposed, plate 10 has a greater sculling angle, while the fast recovery action of spring steel or fiberglass retains the advantages of the fast flutter kick motions of speed swimming.

Figure 7:
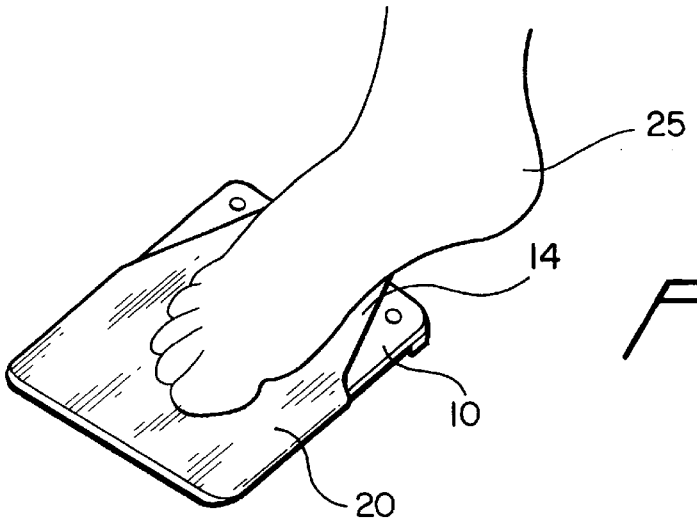
FIG. 7 shows the positioning of the foot on the inner sleeve.

FIG. 7 shows placement of the foot 25 on the inner sleeve 20, which wraps about the flat plate 10 and is inserted in the location of the sleeve 20. The foot is placed on the tapered base portion 14 of the sleeve 20.

Figure 8:
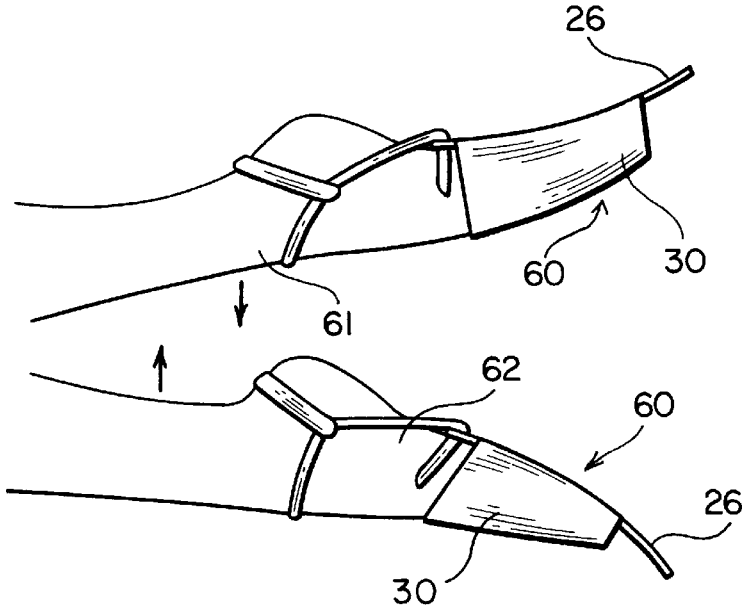
FIG. 8 shows the fins in use,on the feet of a swimmer with the flat plat minimally exposed for purposes of stiffness.

FIG. 8 depicts the invention, i.e., the unique swim fin 60, in use with the feet 61 and 62 inserted in the outer sleeve 30 with the rubber connections 21, 22 holding the feet 61, 62 in the fin 60. A larger sleeve 30 is shown which reduces the plate portion 26 extending outwardly to provide a stiffer fin 56.

Figure 9:
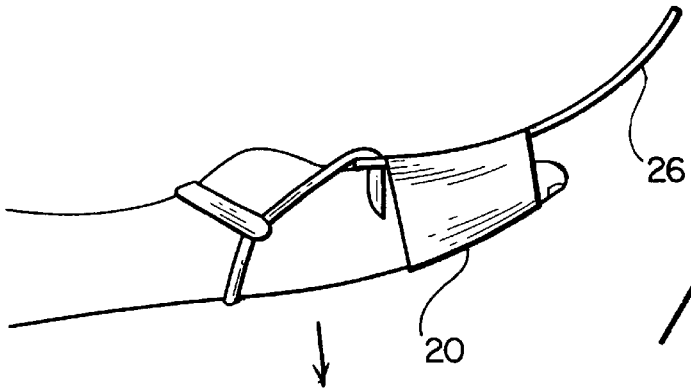
FIG. 9 shows the fin in use with the plate being more exposed than in FIG. 8 and with a shorter sleeve.

FIG. 9 shows a shorter sleeve 20 with a greater exposed plate section 26 that provides more flexibility. Thus it is possible to vary the rigidity of the fin 50 by varying the length of the sleeve 30.

While the invention has been explained by a detailed description of certain specific embodiments, it is understood that various modifications and substitutions can be made in any of them within the scope of the appended claims, which are intended also to include equivalents or such embodiments.

What is claimed is:

1. A swim fin for attachment to a swimmer's foot for the improvement of the fast flutter kick motions of speed swimming comprising:

a thin flexible plate having an upper end portion a lower end portion and an intermediate portion and a first rigid rib mounted along the plate at the upper end and a second rigid rib being mounted to the plate at the intermediate portion thereof parallel to the first rib;

a first flexible sleeve having a forward and rear portion an upper portion and a lower portion each having outer edges joined together to form an envelope for insertion of the flexible plate, said plate engaging and stretching the sleeve edges in a taught relationship to provide an edge to scull water and wherein the envelope provides a cushion between the plate and the foot;

a second flexible sleeve having an aperture extending therethrough, said first flexible sleeve being removably mounted within said second sleeve with the forward portion of the first sleeve extending outwardly from the second sleeve; and, means mounted to the flat plate to engage and maintain a swimmer's foot within the sleeves with the arch of said foot positioned over the lower end portion of the plate.

2. A swim fin for attachment to a swimmer's foot for the improvement of the fast flutter kick motions of speed swimming in accordance with claim 1 wherein:

the flexible plate and the upper rib include two spaced holes; and, the mounting means comprises three elastic loops wherein a first loop includes a first end fitting tightly through one hole in the plate and rib and a second end fitting tightly through the other hole in the plate and rib, and an intermediate portion which fits over the swimmer's heel and second and third loops extending crosswise between the intermediate portion of the first loop to secure the first loop about the foot.

3. A swim fin for attachment to a swimmer's foot for the improvement of the fast flutter kick motions of speed swimming in accordance with claim 1 wherein:

the flexible plate is rigid along its width forming a fulcrum line across that is proximal to a fulcrum line across the width of the bottom of the foot that is proximal to the metatarsal and cuneiform joints to stretch the range of motion of the ankle and the articulating joints distal to the ankle.

4. A swim fin for attachment to a swimmer's foot for the improvement of the fast flutter kick motions of speed swimming in accordance with claim 1 wherein:

the second flexible sleeve encloses the forward portion of the foot to provide a short length to the fin, such that said short length, forward position of the foot and flexing plate react quickly to the action of the flutter kick.

5. A swim fin for attachment to a swimmer's foot for the improvement of the fast flutter kick motions of speed swimming comprising:

a flexible flat plate having a substantial rectangular configuration, having an upper and lower end portion, an intermediate portion and a lower end portion, a first rigid rib mounted across one end portion and a second raised rib being mounted across the intermediate portion;

a circular rubber inside sleeve having open sides and a width formed by said sides which is less than the width of the plate, said sleeve enclosing the plate as a double surfaced closure, having one end taut between the length thereof and the other end forming a double flap with a diagonal shaped end that is tucked under the second rib;

a second circular outside rubber sleeve of the same width as the inside sleeve but having a shorter length, said sleeve being mounted over the inside sleeve and plate located therein such that the outside sleeve holds the foot firmly in place on top of the inside sleeve; and, mounting means securing the plate to the foot.

6. A swim fin for attachment to a swimmer's foot for the improvement of the fast flutter kick motions of speed swimming in accordance with claim 5 wherein:

the mounting means comprises a length of rubber tubing, a first rubber band and a smaller second rubber band wherein the smaller rubber band is positioned to encircle the larger rubber band to form a bow tie shape, or two open loops and through which the rubber tubing is threaded to form its own loop, said rubber tubing being adjustably secured to the plate.

7. A swim fin for attachment to a swimmer's foot for the improvement of the fast flutter kick motions of speed swimming in accordance with claim 6 wherein:

the foot is inserted over the rubber tubing and under tile rubber bands placing the tubing around the back of the heel with the bands over the top of the foot.

8. A swim fin for attachment to a swimmer's foot for the improvement of the fast flutter kick motions of speed swimming in accordance with claim 1 wherein:

the first flexible sleeve includes a forward portion having the upper and lower portions forming an envelope and a rear portion having upper and lower portions and having upper and lower side edges extending inwardly from the outer edges of the forward portion to a predetermined point and then transversely to join with the edges of the other side, said rear upper and lower portions forming an open flap.

9. A swim fin for attachment to a swimmer's foot for the improvement of the fast flutter kick motions of speed swimming in accordance with claim 8 wherein:

the transverse edges of the rear portion are insertable beneath the base of the flat plate.

10. A swim fin for attachment to a swimmer's foot for the improvement of the fast flutter kick motions of speed swimming in accordance with claim 8 wherein:

the flat plate extends outwardly from the second sleeve a predetermined distance related to the flexibility of the fin, the flexibility thereof being determined by the length of said second sleeve.

11. A swim fin for attachment to a swimmer's loot for the improvement of the fast flutter kick motions of speed swimming comprising:

a thin flexible plate having an upper end portion a lower end portion and an intermediate portion and a first rigid rib mounted along the plate at the upper end and a second rigid rib being mounted to the plate at the intermediate portion thereof parallel to the first rib;

a flexible sleeve having an aperture extending therethrough, said flexible sleeve being removably mounted about the plate with a swimmer's foot being secured between the plate and the sleeve; and, means mounted to the flat plate to engage and maintain a swimmer's foot within the sleeve with the arch of said foot positioned over the lower end portion of the plate.

* * * * *